US005615785A

United States Patent [19]

Kaner

[11] Patent Number: 5,615,785

[45] Date of Patent: Apr. 1, 1997

[54] IN-VEHICLE DEVICE FOR MOVING AND STORING OBJECTS

[75] Inventor: Albert Kaner, Sylvan Lake, Mich.

[73] Assignee: AGC Research and Development Corp., Southampton, N.J.

[21] Appl. No.: 538,513

[22] Filed: Oct. 3, 1995

[51] Int. Cl.[6] ..... B66C 23/44

[52] U.S. Cl. ..... 212/180; 212/231; 212/253; 212/348; 414/541; 414/921

[58] Field of Search ..... 212/180, 181, 212/231, 253, 347, 252; 414/462, 541, 542, 543, 546, 547, 549, 555, 559, 921

[56] References Cited

U.S. PATENT DOCUMENTS

| | | | |
|---|---|---|---|
| 251,858 | 10/1951 | Garland | 212/231 |
| 2,571,858 | 2/1954 | Garland | 212/231 |
| 3,410,585 | 11/1968 | Trevisan | 212/253 |
| 3,757,959 | 9/1973 | Thompson et al. | 212/347 |
| 4,221,528 | 9/1980 | Gordos | 414/462 |
| 4,639,182 | 1/1987 | Inaba et al. | 212/231 |
| 4,957,207 | 9/1990 | Thomas | 212/231 |
| 5,486,082 | 1/1996 | Feldman et al. | 414/542 |

FOREIGN PATENT DOCUMENTS

| | | | |
|---|---|---|---|
| 843024 | 8/1960 | United Kingdom | 212/231 |

*Primary Examiner*—Thomas J. Brahan
*Attorney, Agent, or Firm*—Gerald S. Rosen

[57] ABSTRACT

An in-vehicle device for lifting objects into and out of the storage areas of the vehicle in which it is installed. The device is attached to the inside wall, floor, or ceiling area of the vehicle in which it is installed. It is fixedly attached to the vehicle by a mounting element which is connected to a swivel base element containing, in one embodiment, a winch with a cable running through a telescoping arm protruding from the base. The arm telescopes into and out of the base. The cable has a hook on its end to enable it to hook onto handles or ropes on objects to be stored in the vehicle and removed therefrom to a desired location. The winch is operated manually or by an electric motor or other mechanical means. The mounting element is attached to the vehicle by bolts, rivets, adhesives and the like. The base can be connected to the mounting element by a ball and socket joint to enable it to swivel in all directions, or it can be connected by a joint which enables it to swivel horizontally only. The mounting element can also be fixed to the vehicle by means of brackets. The telescoping arm has a ball and socket wrist joint to enable it to rotate in all directions, enabling it to move the cable with hook to objects not directly below the hook, or to, with the help of the swivel base, unload objects to locations not directly below it.

10 Claims, 13 Drawing Sheets

IN-VEHICLE DEVICE FOR MOVING AND STORING OBJECTS

BACKGROUND

This invention relates to an in-vehicle telescoping arm device attached to the vehicle via a base and a fixed mounting element so the arm can swivel horizontally and/or vertically on the fixed mounting. The arm device can lift, via a hook and winch structure, objects to be stored into the storage area of the vehicle, e.g. the trunk of an automobile, the storage area of a jeep or enclosed truck or van or a pick-up truck or boat, and deposit such objects therein or thereon. The device can also lift such objects out of the storage area of the vehicle and deposit them to a desired place such as a platform, a dolly, the ground and other places which are remote from the vehicle.

The device is thus useful for civilian, military or law enforcement purposes. The arm element is retractable and compact so that when not in use, it can be conveniently stored in the vehicle without significantly encroaching on the storage area. The device is helpful for aiding the handicapped or elderly move luggage and packages into or out of a vehicle such as an automobile. The device of the invention is convenient for use by elderly and handicapped persons or others who cannot readily lift objects such as suitcases, packages and the like. It is more convenient than presently used means, e.g. dollies, to lift and move objects such as suitcases or packages from one location such as the ground or a loading platform to a desired location, e.g. a storage or carrying area of a vehicle.

SUMMARY OF INVENTION

This invention provides an in-vehicle device for lifting objects into or out of the storage areas of such vehicles. The vehicles which are suitable for use with this invention are, for example, an automobile, a van or enclosed truck, a pickup truck, a boat, a military vehicle and other vehicles that are suitable or adaptable for having the device attached thereto. The location for attachment of the device of the invention inside automobile trunks is preferably on the ceiling portion of the trunk between the front edge of the trunk opening and the rear window of the automobile. The location in vans or closed trucks is preferably on an inside wall at the rear of the storage area of the vehicle, although the location can also be on the floor or ceiling thereof. The location of attachment of the device in open trucks such as pickup trucks is preferably on the floor of the storage area. The location in boats varies with the type of boat and can be, e.g. floors, ceilings or bulkheads in holds or on decks of such boats. For other vehicles, such as jeeps, buses and trains the locations for attachment are determined by the structure of the vehicle. Out-of-vehicle locations for placing the objects from the vehicle having the device of the invention attached thereto are docks, platforms, the ground and other areas suitable for storage of the objects or for placing the objects for immediate use. In addition, the objects can be placed upon means for transporting them to another location such as dollies or fork-lifts or from one vehicle to another, e.g. from a van to a boat or to an automobile.

The device comprises a telescoping robotic arm attached to a base which is pivotally attached by a ball and socket joint to a fixed mounting support element, which support element can be fixedly attached to a vehicle in the locations as discussed supra or fixed to a bracket element which is fixedly attached to a vehicle at the desired location. This structure allows the arm to rotate horizontally and/or vertically. The mounting element can be mounted removably or permanently, for example, by welding or with an adhesive or fasteners such as bolts or rivets, to the floor, sidewalls or ceiling of the vehicle storage area. The preferred mounting is a permanent mounting.

The robotic arm is hollow and telescopic so that when not in use it can be telescoped into its base. In this way, the device will not encroach significantly into the storage space. The arm is made of a plurality of concentric hollow tubes, preferably three, that can be telescoped. The first or wrist end of the arm, i.e., that end of the arm not attached to its base, is a swivel joint such as a ball and socket which moves vertically and horizontally. A cable runs from a winch through the arm and wrist. A carrying means, such as a hook affixed on the end of the cable at the wrist end of the arm is adapted to hold onto and lift or lower objects such as luggage or packages into or out of the storage area of the vehicle. The cable is raised or lowered by the winch which is protected from slipping by either a ratchet mechanism, brake, the electric motor which turns the winch or other means such as a pin. Such protecting means can also allow the operator to hold the winch in a desired position. The second end of the cable, i.e. that end of the cable not at the wrist end of the arm, is attached to the winch. The winch can be inside or outside the swivel base and is operated by a hand crank or, preferably, by means such as an electric motor mounted therewith and powered by a battery or other electric power source. The ratchet mechanism is a conventional toothed wheel that operates with a catch and a pawl, each of which allows the ratchet wheel to move in only one direction while blocking movement in the opposite direction. The catch is used when the winch rotates axially in the direction which winds up the cable so the hook thereon raises the item being lifted. The pawl prevents slippage in the opposite direction.

DETAILED DESCRIPTION

The invention can be best understood with reference to the drawings.

Figure 1:
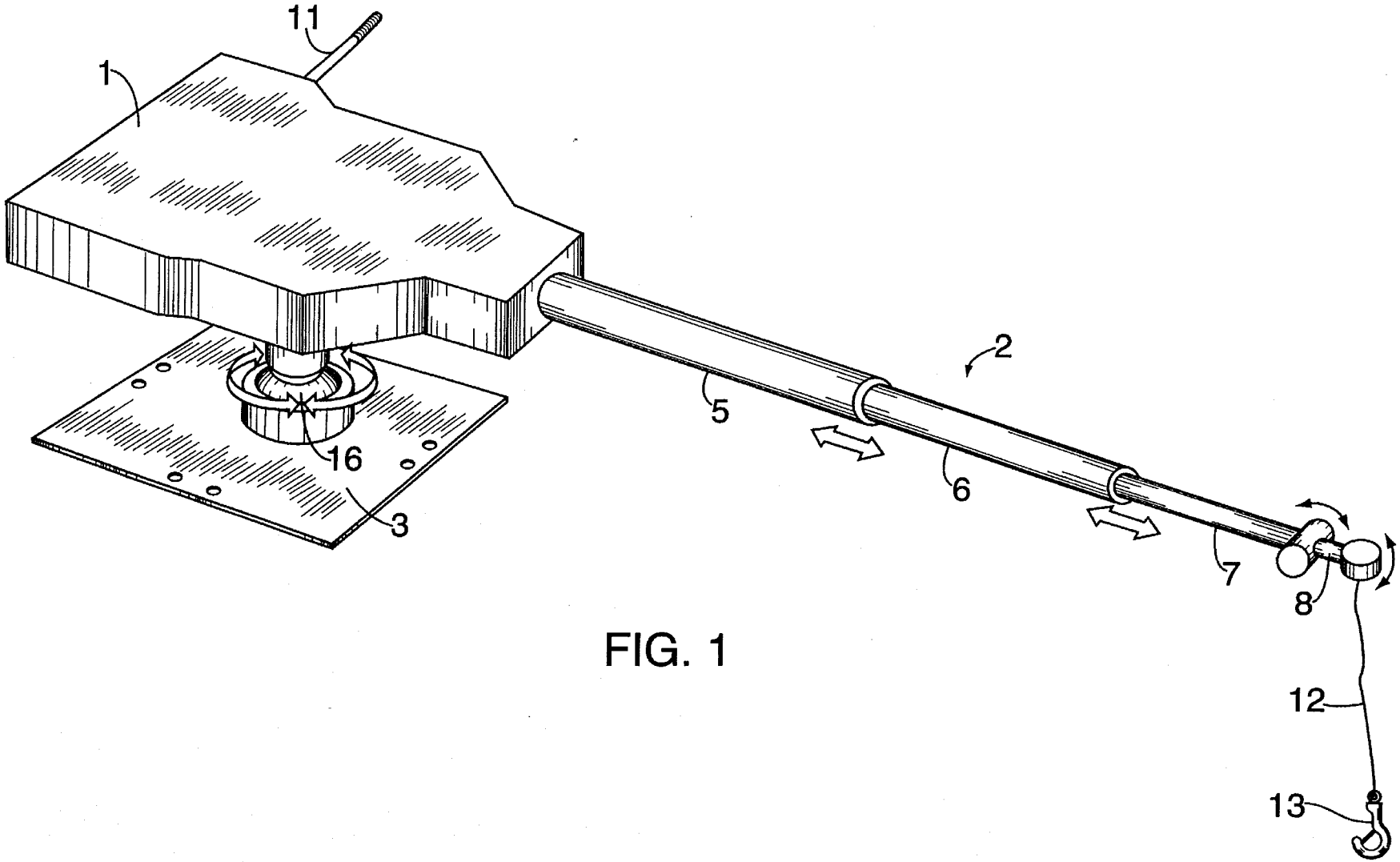
FIG. 1 is a perspective view of the device of the invention showing a floor mount embodiment with arrows showing horizontal swivel direction of its base, horizontal and vertical swivel direction of the wrist, the arm of a crank for an internal winch and its direction of axial rotation as well as a telescoping arm and its direction of movement.
Figure 1A:
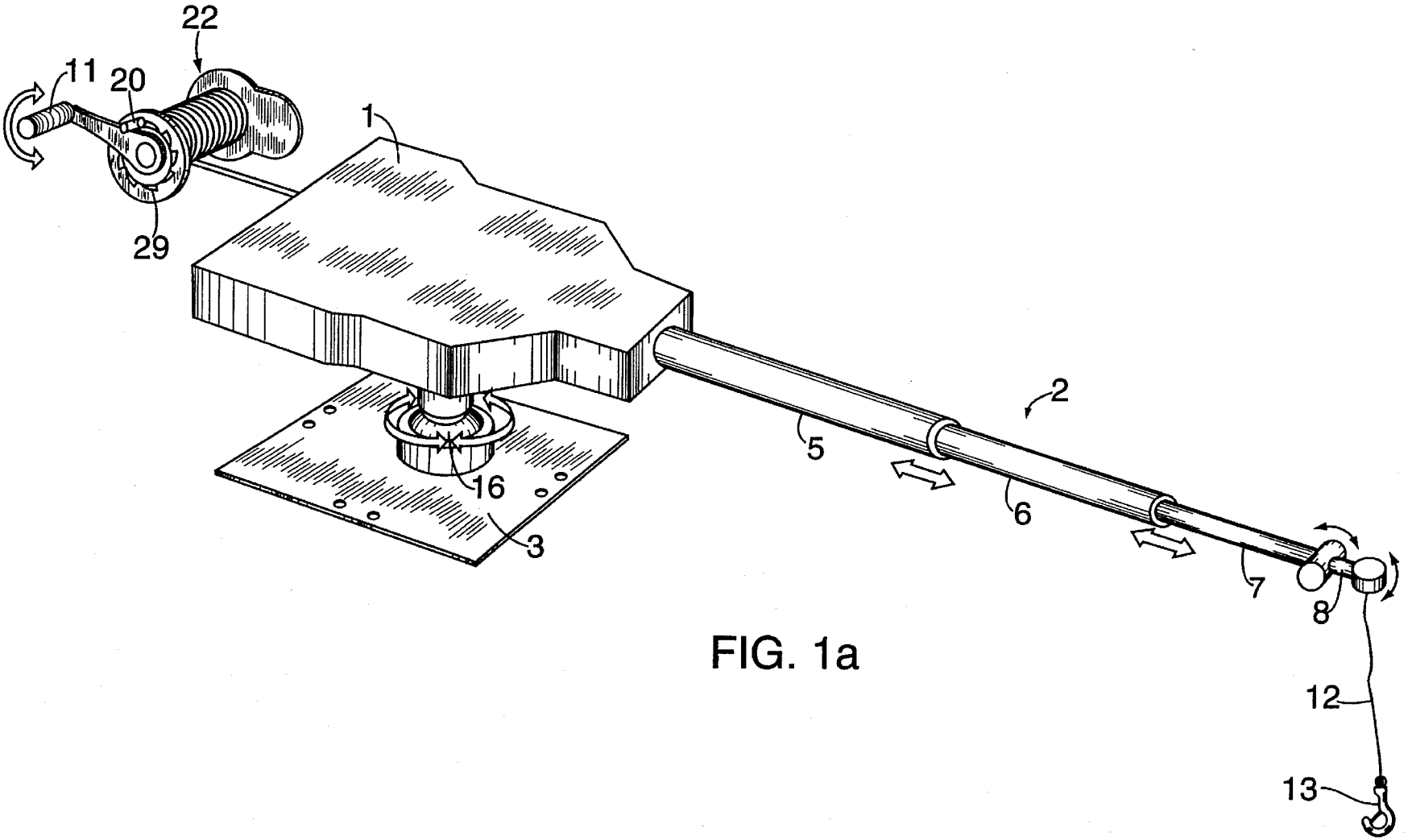
FIG. 1*a* is a perspective view of the device showing a floor mount embodiment with arrows showing horizontal swivel direction of the base, horizontal and vertical swivel direction of the wrist, the arm of a crank for an external winch and its direction of axial rotation as well as a telescoping arm and its direction of movement.
Figure 2:
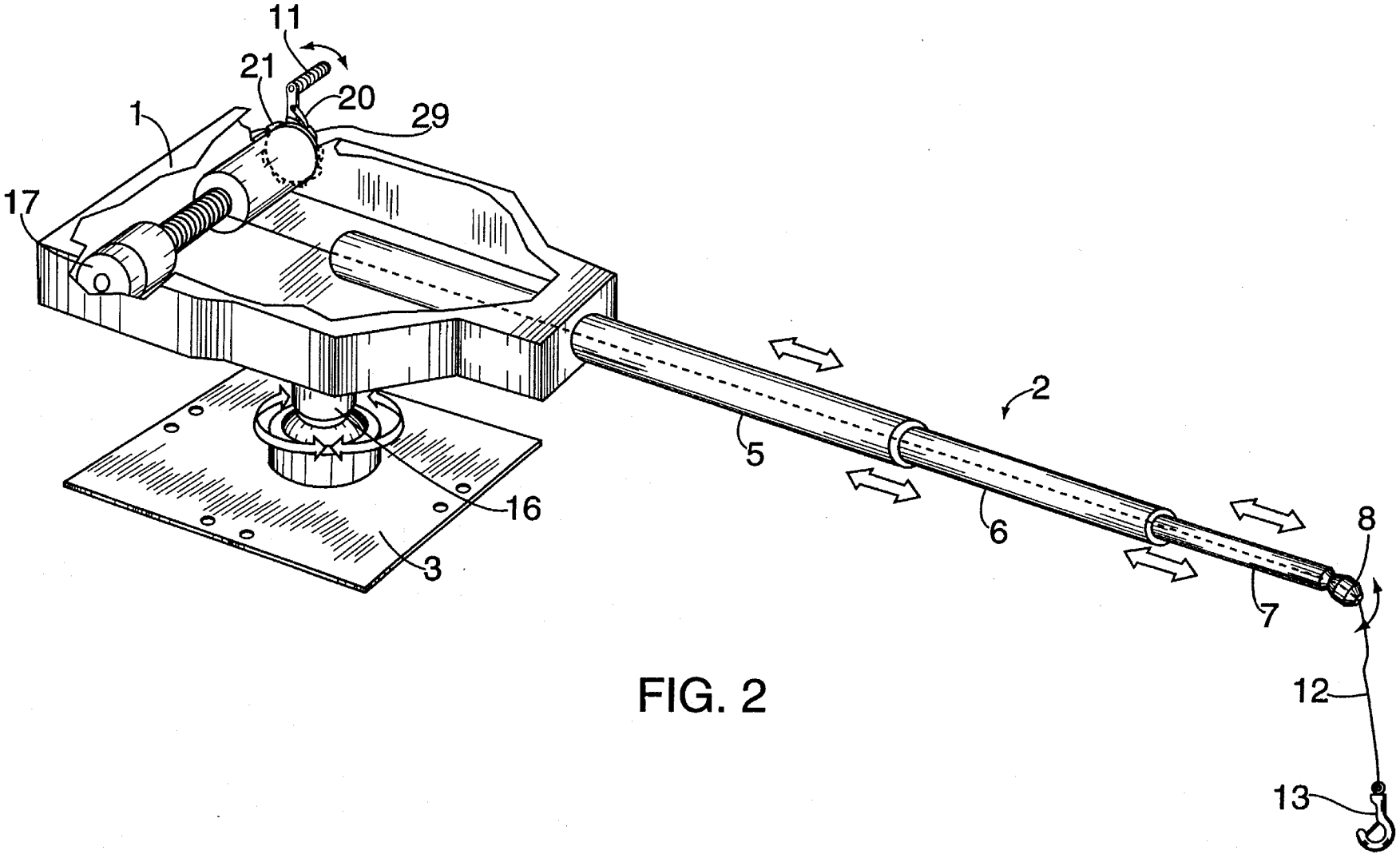
FIG. 2 is a perspective partial cutaway view of the swivel base showing the telescoping arm and an internal ratcheted winch with a crank.
Figure 4:
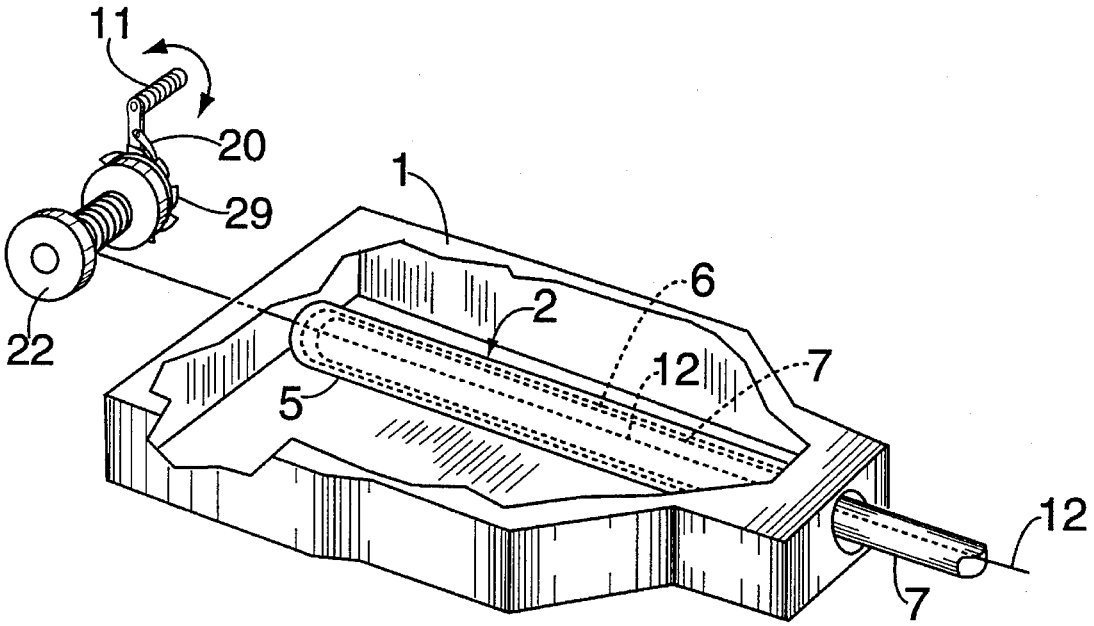
FIG. 4 is a fragmentary perspective partial cutaway view of the base showing the telescoped arm and external ratcheted winch with a crank.
Figure 4A:
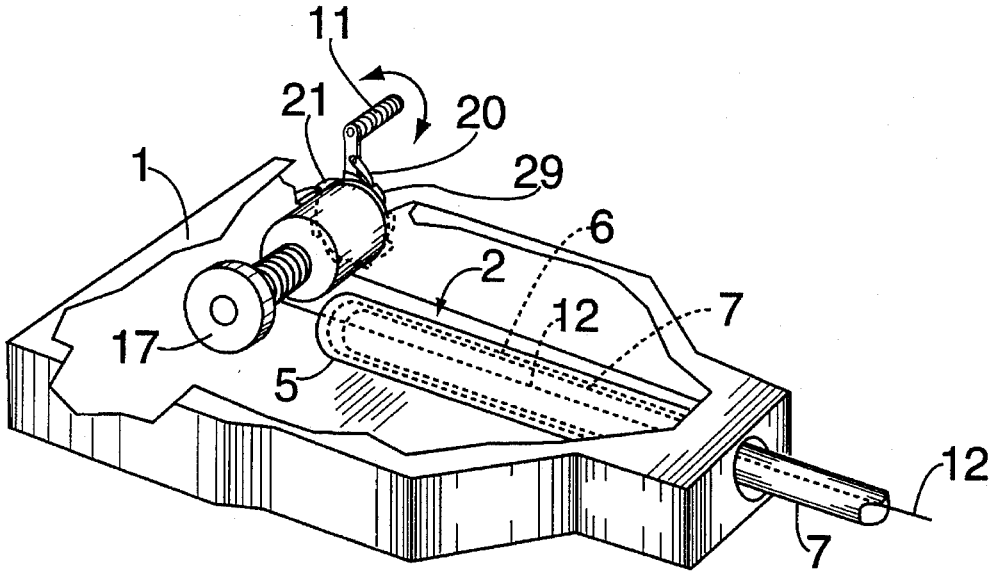
FIG. 4*a* is a fragmentary perspective partial cutaway view of the base showing the telescoped arm and an internal ratcheted winch with a crank.
Figure 5:
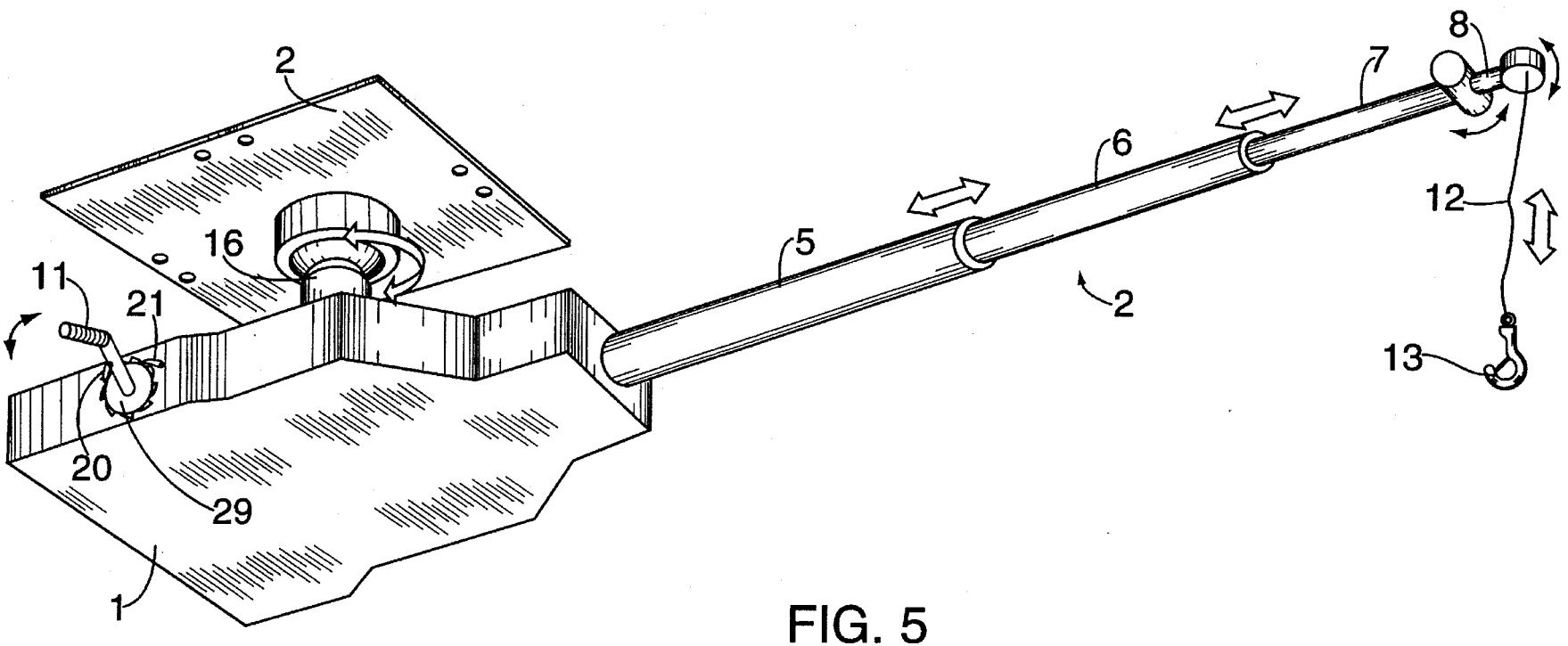
FIG. 5 is a perspective view of the device showing a ceiling mount embodiment with an internal winch with a crank and ratchet with arrows showing the direction of rotation of the crank arm, horizontal and vertical swivel direction of the base, horizontal and vertical swivel direction of the wrist, direction of movement of the winch cable and telescopic direction of the arm.
Figure 6:
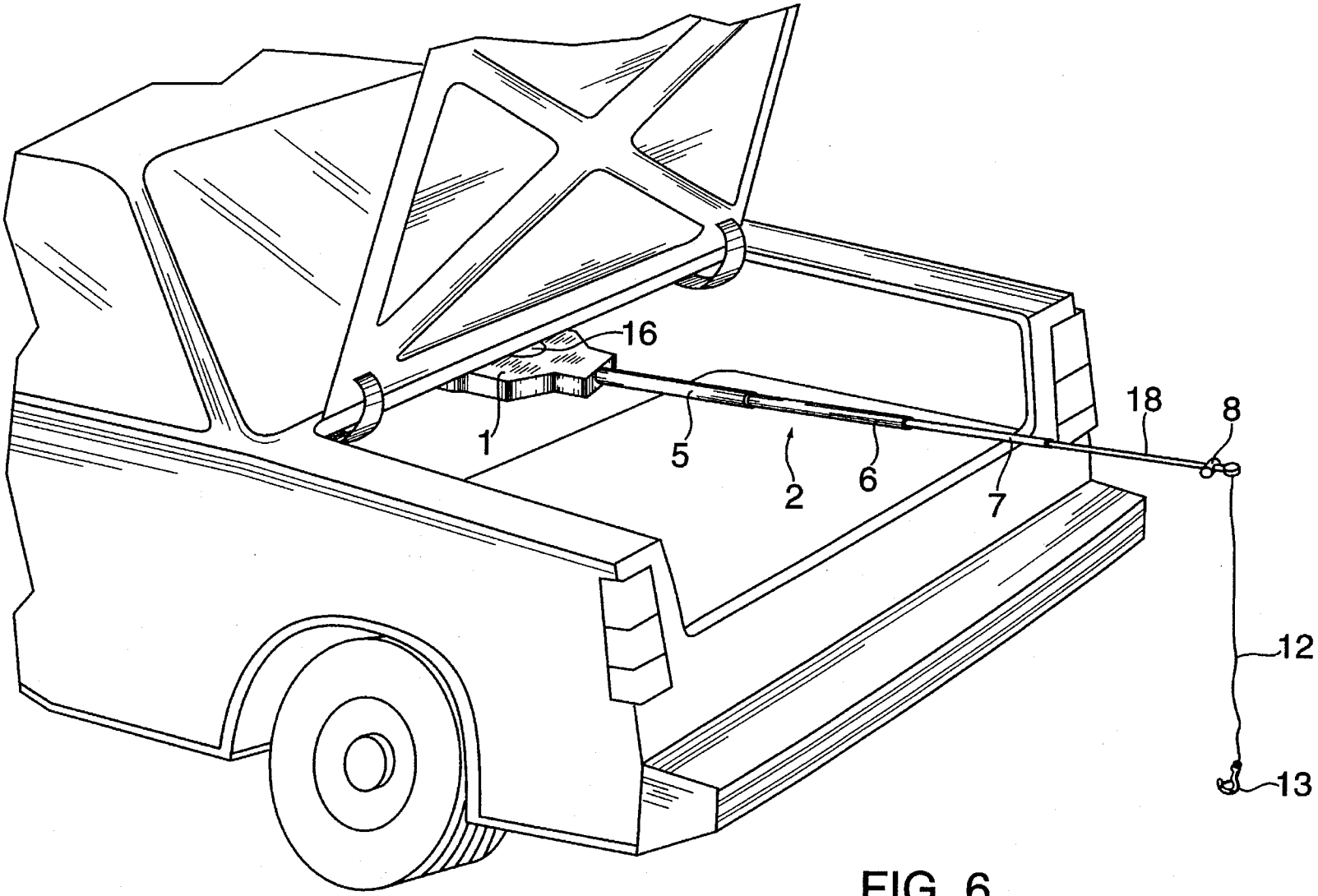
FIG. 6 is a perspective rear view of an automobile with its trunk open showing the device of the invention mounted on the inside ceiling of the trunk.
Figure 7:
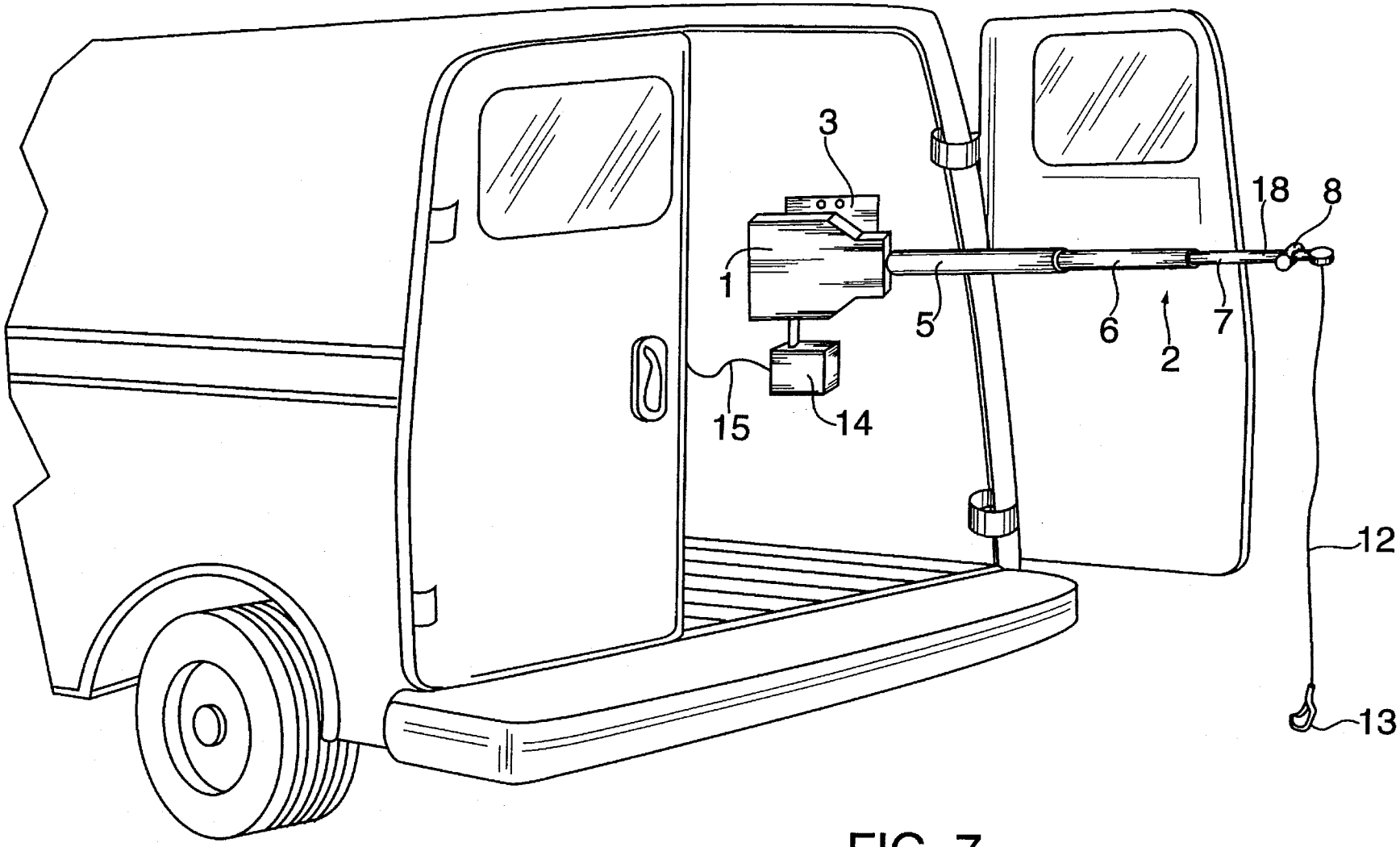
FIG. 7 is a perspective rear view of a van with its rear door open showing the device of the invention and an electric motor operatively connected therewith mounted on an inside wall thereof.
Figure 8:
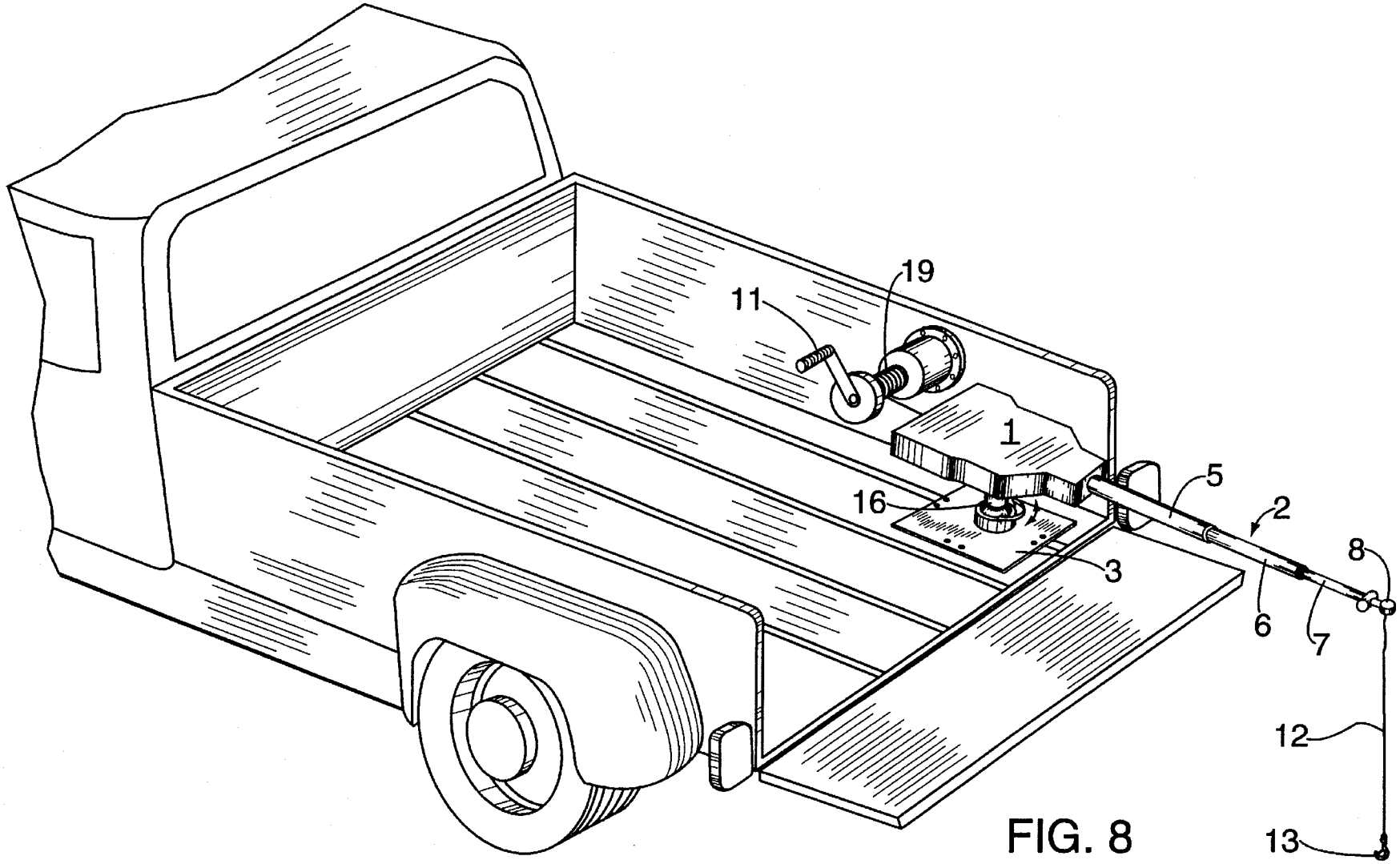
FIG. 8 is a perspective rear view of a pickup truck showing the device of the invention with an external ratcheted winch mounted on the bed thereof.
Figure 11:
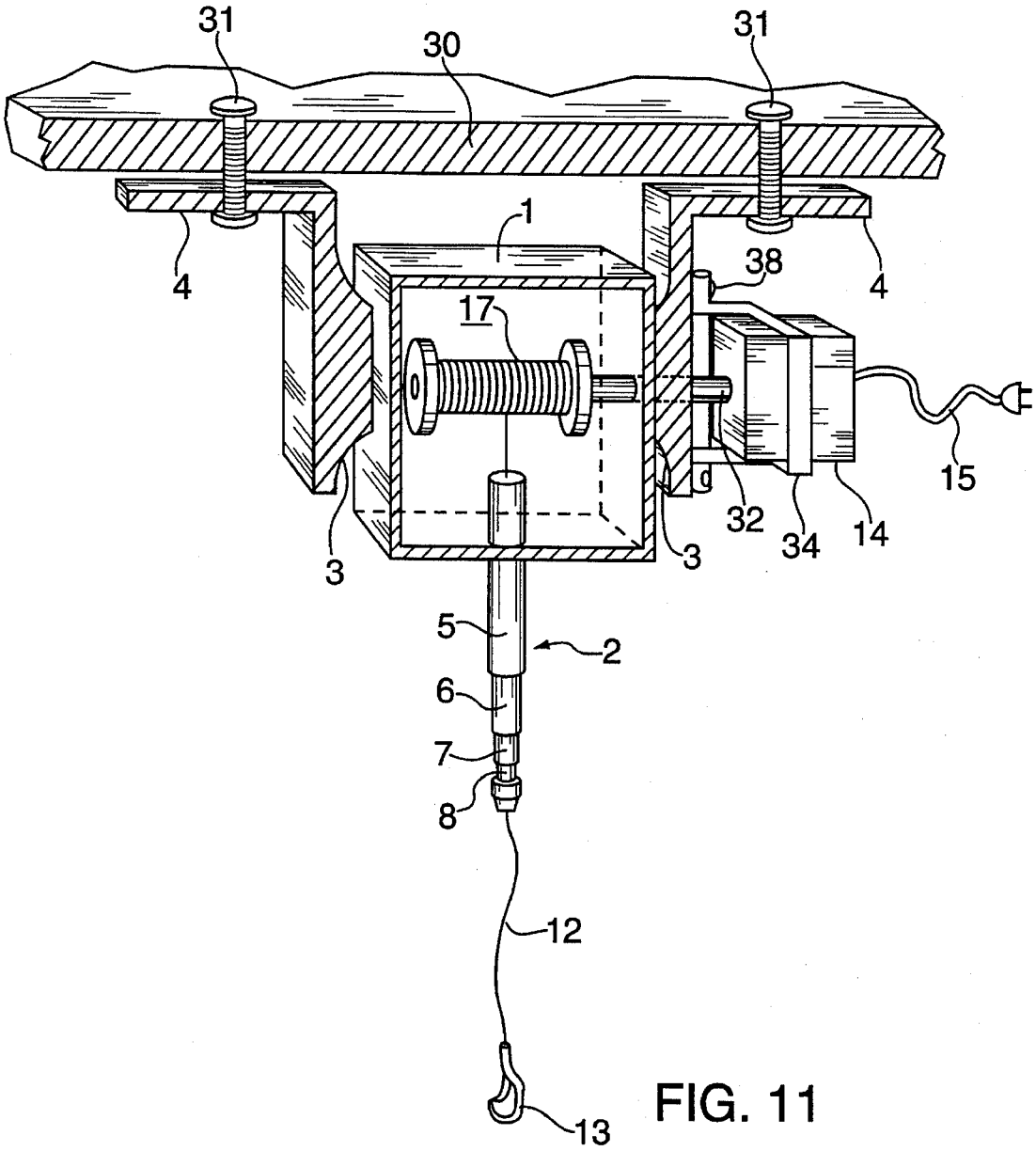
FIG. 11 is a sectional rear partial fragmentary view of a vehicle ceiling showing the device with electric motor attached to the ceiling thereof via a bracket.
Figure 12:
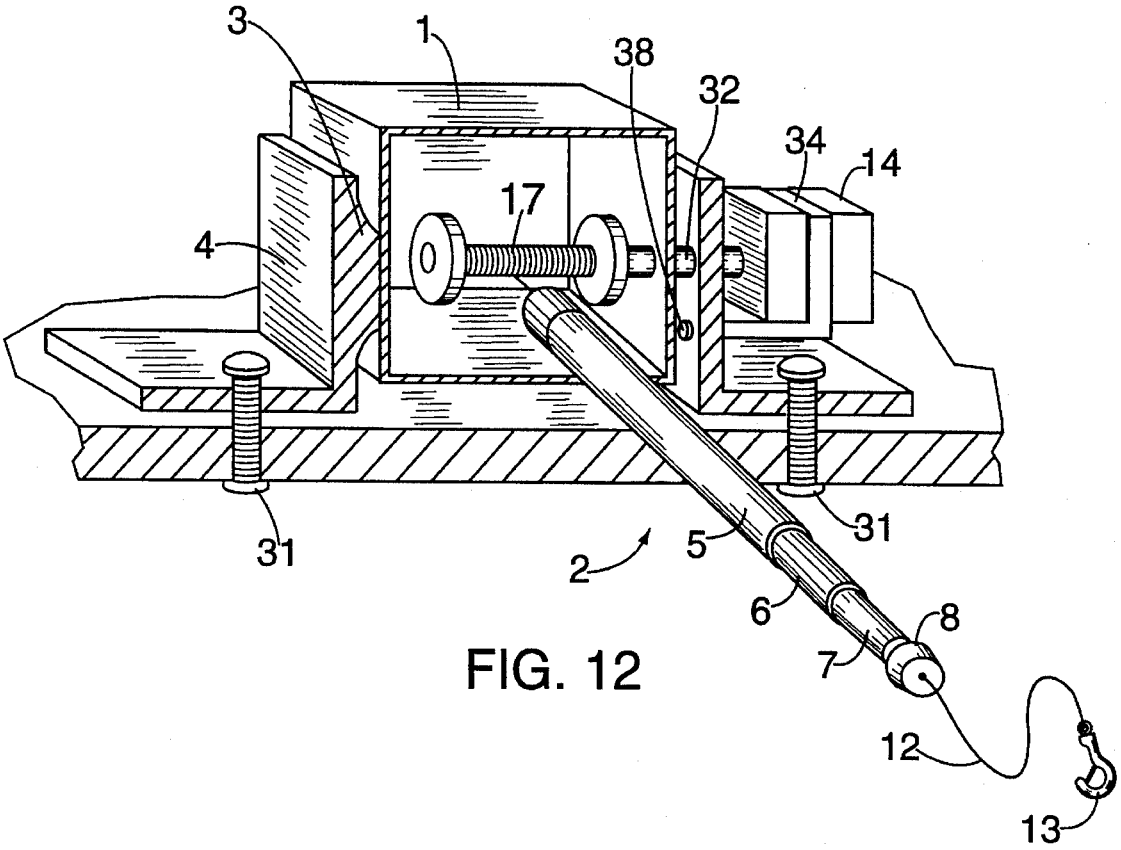
FIG. 12 is a sectional rear partial fragmentary view of a vehicle floor or bed showing the device with electric motor for turning the winch attached to the floor or bed with a bracket.
Figure 13:
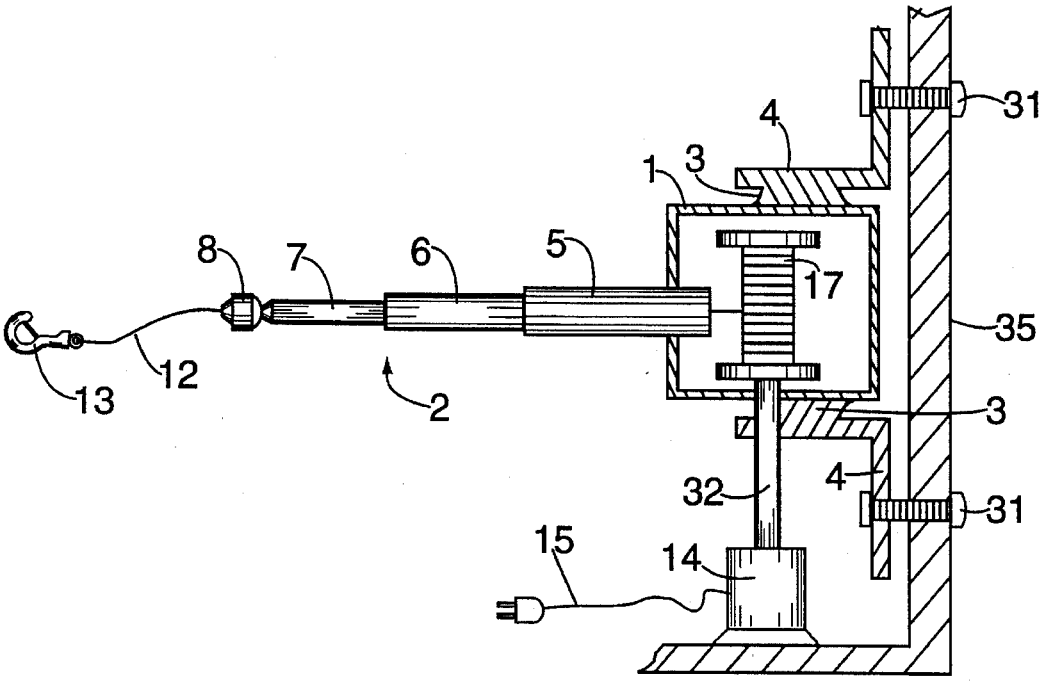
FIG. 13 is a sectional top partial fragmentary view of a side wall of a vehicle showing the device attached to the inside of the wall with a bracket, and an electric motor for turning the winch attached to the floor thereof.
Figure 14:
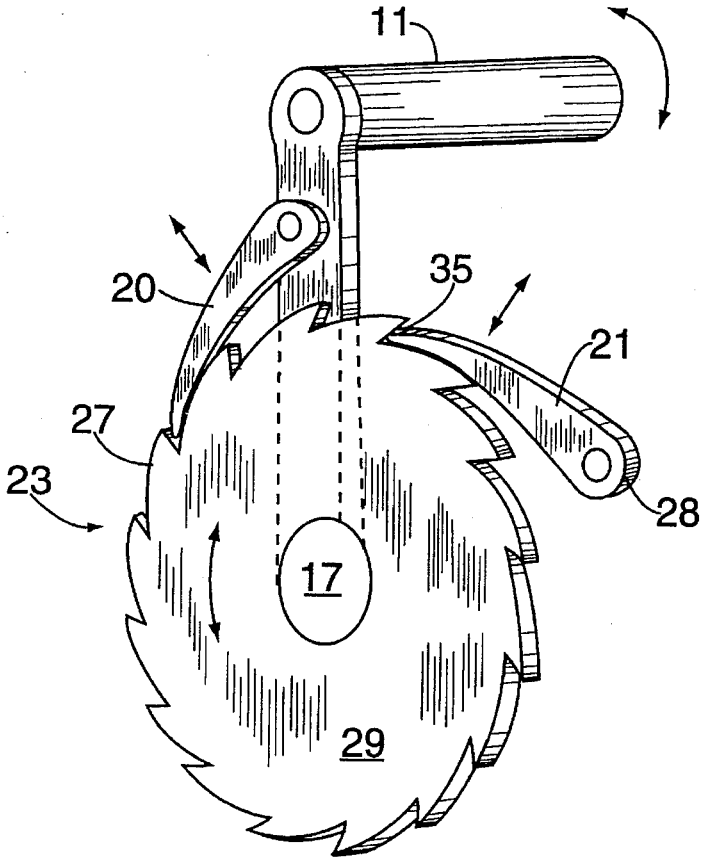
FIG. 14 is a side view of the ratchet mechanism showing the direction of movement of each element.

As shown in FIGS. 1 and 1*a* the device of the invention comprises a swivel base 1 having therein either an internal winch 17, illustrated in FIGS. 2 and 4*a* with a hand crank 11 which is used to operate the internal winch 17 or an external winch 19 as shown in FIG. 1*a*, 4 and 8. The internal winch 17 can be moved by the hand crank 11 so it moves the cable 12 up and down through the telescopic arm 2 through a ball and socket wrist joint 8 enabling the carrying means (illustrated as a hook) 13 to lift or lower a package or suitcase or any other item being moved. A ratchet mechanism 23 as illustrated in FIG. 14 is concentrically attached to the axle of the internal winch 17 so the ratchet wheel 29 is fixed on the axle as it emerges from the wall of the swivel base 1 and rotates with it. The crank handle 11 is on the outer part of the axle so the ratchet wheel 29 is between the swivel base 1 and the crank handle 11 on the axle of the internal winch 17. Attached to the crank handle 11 intermediate its attachment to the axle of the internal winch 17 and its end not attached to the axle is a catch 20 as shown in FIGS. 2, 4*a* and 5. The catch 20 is sufficiently long to block the ratchet wheel 29 from moving in a direction which unrolls the cable 12 by engaging a tooth 27 on the perimeter of the ratchet wheel 29. The catch 20 is continually engaged to the wheel 29 and slides over the notches or teeth 27 as the winch 17 is being wound up, only when the winch 17 winding is stopped does the catch 20 engage a tooth 27 on the ratchet wheel 29. The catch 20 can be disengaged from the ratchet wheel 29 by rotating it away from the wheel 29 parallel to the plane of the ratchet wheel 29, thus allowing the winch 17 to be turned in the unwind direction. A pawl 21 is rotatably attached at the first 28 of its two ends to the outside of the sidewall of the swivel base 1 near the ratchet wheel 29 so that its second 35 of two ends can engage the teeth 27 of the ratchet wheel 29 to prevent slippage when the winch 17 is being unwound. The pawl 21 in not always needed in the device of the invention because the catch 20 is usually sufficient to prevent slippage. Other means to prevent slippage such as a brake on the axle or an obstructing pin or other mechanical means can be used in the practice of this invention. The swivel base 1 is swivelingly attached to a mounting element 3 through a joint 16. The mounting element 3 is fixedly attached to a vehicle storage area such as an automobile trunk as illustrated in FIG. 6 wherein the mounting element 3 is attached to the ceiling 30 of the trunk of the automobile between the rear window and the opening of the trunk. FIG. 11 shows an embodiment of the invention in which the fixed mounting element 3 is attached to the ceiling 30 of an automobile trunk by means of a pair of L-shaped brackets 4 that are fixedly attached to ceiling 30 of the trunk between the rear window of the automobile and the opening of the trunk by means of bolts 31 although the brackets 4 can also be attached by rivets, adhesives or welds. As shown in FIGS. 11, 12 and 13, the winch 17 is operated by an electric motor 14 that has a rotary extension 32 that extends through the bracket 4 and the mounting 3 into the winch 17 where it acts as the axle of the winch 17. As shown in FIGS. 11 and 12 the motor 14 is attached to the bracket 4 by a fixed motor mounting element 34 that is attached by bolts 38, although rivets, adhesives or welds are also suitable. In FIG. 13 where the brackets 4 are attached to the sidewall 35 of the vehicle, the electric motor 14 is shown attached to the floor of the vehicle, the motor 14 can also be attached to the brackets 4. The electric motor 14 is connected to a power source by an electrical cord 15. The power source can be either an out-of-vehicle source such as a socket bringing public or private utility electricity, an electric generator, or a battery, including the vehicle's battery. In a preferred embodiment, the device is built into the vehicle either during manufacture or as an add-on and uses the electricity from the vehicle's battery.

Figure 3:
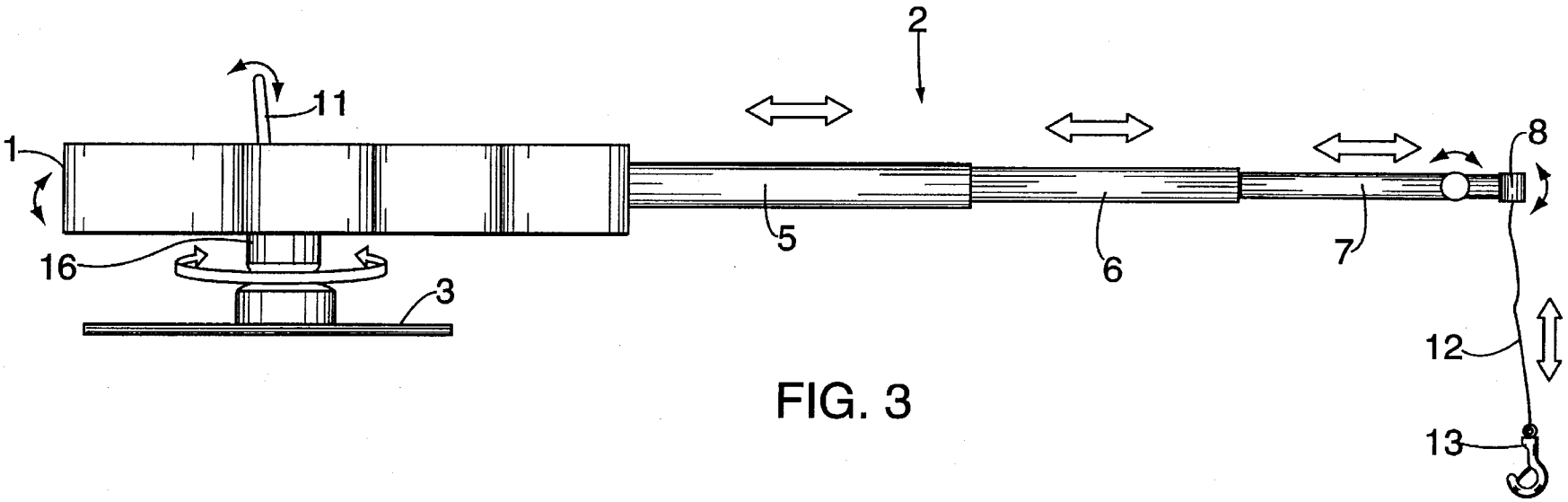
FIG. 3 is a side view of the device showing a floor mount embodiment with arrows showing the horizontal and vertical swivel directions of the base, the telescoping direction of the arm, the direction of movement of the wrist and the direction of movement of the winch cable.
Figure 9:
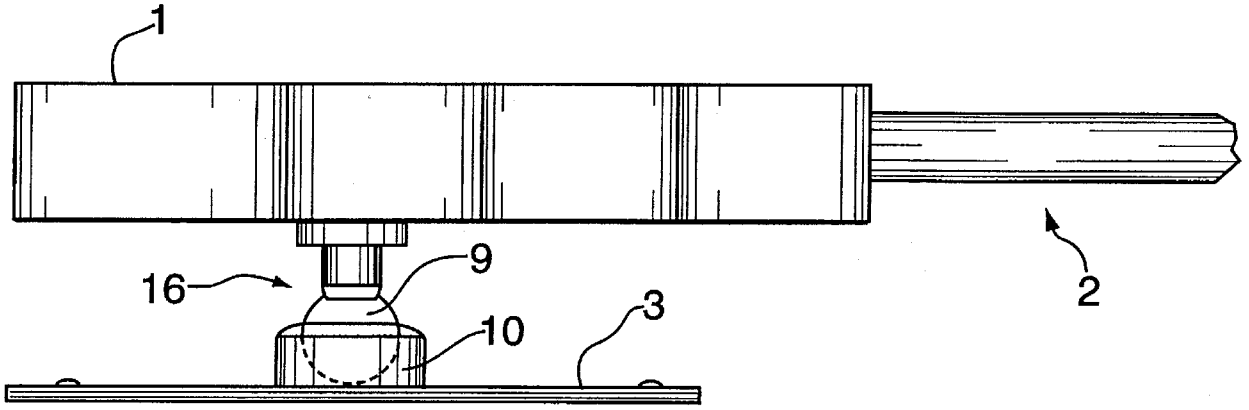
FIG. 9 is a side elevational view illustrating a ball and socket joint between the swivel base and the fixed mounting element of the device wherein the socket is part of the fixed base and the ball is part of the swivel base.
Figure 10:
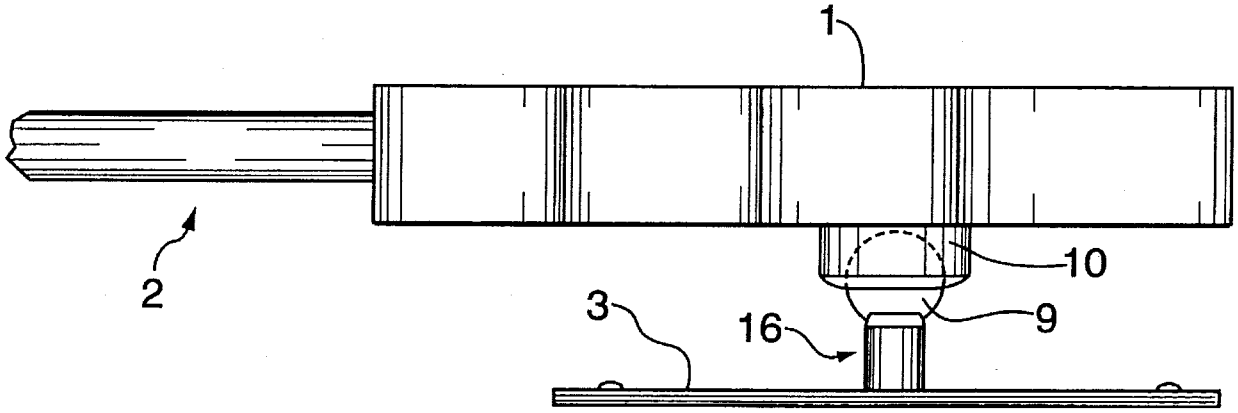
FIG. 10 is a side view illustrating a ball and socket joint between the swivel base and the fixed mounting element of the device wherein the socket is part of the swivel base and the ball is part of the fixed base.

The swivel base 1 can be attached to the mounting element 3 by a joint 16 which allows the base 1 to swivel horizontally as shown in FIGS. 1, 1*a* and 2 or horizontally and vertically as illustrated by FIGS. 3, 5 and 8, via a ball 9 and socket 10 joint as shown in FIGS. 9 and 10. The ball 9 can be part of the swivel base 1 and fit into a socket 10 which is a part of the fixed mounting element 3, or the ball 9 can be part of the fixed mounting element 3 and fit into a socket 10 which is a part of the swivel base 1.

Figure 15:
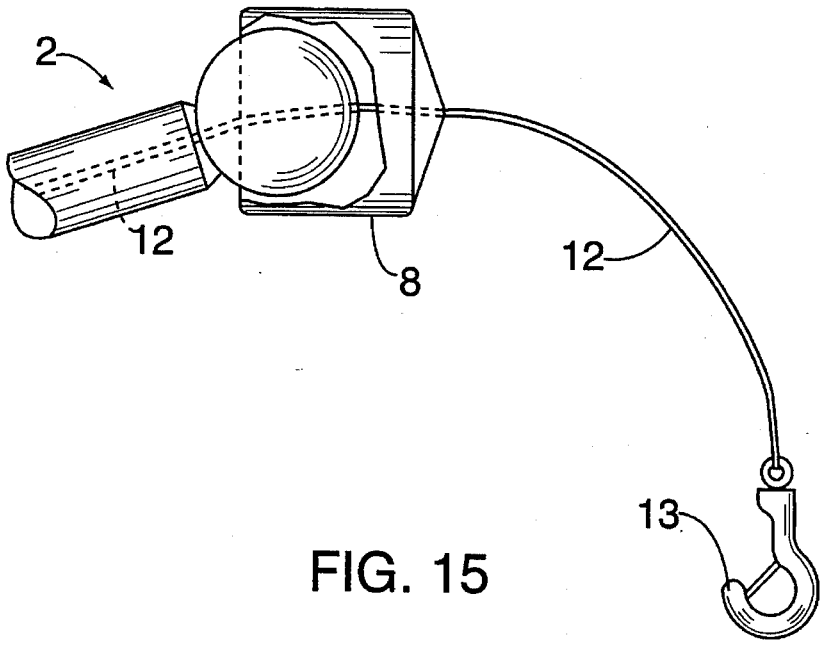
FIG. 15 is partial cutaway view of the ball and socket wrist joint of the device.

The telescoping robotic arm 2 with a ball and socket wrist joint 8 is illustrated in FIGS. 1–8, and 11–13. The ball and socket wrist joint 8 is shown in detail in FIG. 15 wherein the ball 40 is rotatably attached to the arm 2 via a base 42 and is swivelingly attached to a socket 41 forming the wrist 8 which can thus rotate in all directions. The telescoping arm 2 comprises a plurality of concentric hollow tubes 5, 6 and 7 as shown, for example, in FIG. 1. The number of such hollow tubes can vary, depending on the size needed to accomplish the purpose of lifting items and placing them in or taking them out of a vehicle. The size of the vehicle and weight of the item are factors to take into consideration. Generally, from three to five concentric hollow tubes are sufficient, although as shown in FIG. 6, a fourth tube 18 is needed to extend the cable 12 outside the vehicle. Referring to FIG. 1, tube 5 fits into an opening in the forward wall of the swivel base 1 where it is a sufficiently small circumference to allow it to slide into the swivel base 1 as seen in FIGS. 4 and 4*a*. The largest diameter or outside hollow tube 5 has a flange on its end which is in the swivel base 1 to prevent it from sliding out of the swivel base 1. The length of the outer tube 5 is sufficient for it to fit in the swivel base 1. Each succeeding smaller diameter tubes 6 and 7 fit into the outer tube 5 and the smallest diameter tube 7 fits into the intermediate diameter tube 6. The smaller inside tubes 6 and 7 have sufficiently small circumferences to allow the smallest tube 7 to slide into the intermediate size tube 6 which, in turn, slides in the largest tube 5. The telescoping robotic arm 2 arm is attached to a ball and socket joint 8 at its end which is remote from the swivel base 1 via the smallest diameter tube which fits into the joint 8. The cable or rope 12 is threaded from the winch 17 through the telescoping robotic arm 2 and through the wrist joint 8. At the end of the cable 12 not attached to the winch 17 is a means to hold an item for lifting into or out of a vehicle. Preferably, a hook device 13 is used. The arm 2 is telescoped into the swivel base 1 when not in use. It is telescoped so that only the wrist joint 8 and the end of the cable 12 with the hook 13 are outside the swivel base 1. The materials used to fabricate the device of this invention are readily available heavy plastics, cast aluminum or other light-weight strong materials. The cable can be rope or a steel cable. Other materials obvious to the skilled artisan are contemplated for use in the manufacture of the device of this invention.

The device is especially useful for loading and unloading luggage to and from trunks of automobiles. Thus, when baggage is placed outside the trunk of an automobile for loading where the device of the invention is installed and telescoped into the trunk, the user reaches into the trunk and pulls the telescoping arm out so the cable therein reaches over the edge of the trunk and hangs over the baggage. Then the user hooks the handle of the baggage with the hook on the end of the cable and rewinds the cable to lift the baggage into the automobile trunk where it is released from the cable onto the floor of the trunk. The arm is then telescoped into the swivel base and the automobile trunk closed. The baggage is removed from the trunk of the automobile by hooking the cable to the handle of the baggage, lifting the baggage by winding the winch, pulling the telescoping arm out of the swivel base while unwinding the winch and swinging the luggage to the place where it is to be deposited. The baggage is then lowered or raised to the desired location, e.g a train platform, dolly or floor and unhooked from the cable. The winch is then wound up and the arm telescoped into the swivel base.

The invention as described can be modified by means conventional in the art and such modifications are intended to be covered, limited only by the appended claims.

I claim:

1. A telescoping arm device adapted for attachment to the inside of an automobile trunk, said device including a hollow swivel base and a fixed mounting element wherein the telescoping arm of said telescoping arm device contains a cable running through it from a winch at one end through a swivel wrist joint at a second end wherein (a) said hollow swivel base is adapted to receive said telescoping arm containing said cable running through it, said hollow swivel base is attached by a joint allowing said hollow swivel base to swivel on said fixed mounting element which is fixed to an inside surface of said automobile trunk forward of the juncture of a hinge of a lid or door of said automobile trunk and on the chassis of an automobile at the rear of said automobile;

(b) said telescoping arm is comprised of a plurality of concentric tubes which telescope into said hollow swivel base, which telescoping arm has a ball and socket wrist joint on its end which is remote from said hollow swivel base and said cable with two ends, one end is attached to said winch and the other end is attached to a hook, said cable runs through said wrist joint and the innermost of said concentric tubes to said winch, whereby (c) said winch to which said cable is attached raises and lowers said cable.

2. The device of claim 1 wherein said winch is inside said hollow swivel base and is operatively attached to a hand crank.

3. The device of claim 1 wherein winch is inside said hollow swivel base and is operatively attached to an electric powered motor.

4. The device of claim 1 wherein said winch is outside said hollow swivel base and is operatively attached to a hand crank.

5. The device of claim 1 wherein said winch is outside said hollow swivel base and is operatively attached to an electric motor.

6. The device of claim 1 mounted on the ceiling of said automobile trunk on said chassis of said automobile at the juncture of the rear window of said automobile and the top front of said trunk opening.

7. The device of claim 1 wherein the joint between said fixed mounting element and said hollow swivel base is a ball and socket joint.

8. The device of claim 1 wherein said cable running through said telescoping arm is a rope.

9. The device of claim 1 wherein said winch is operatively attached to a ratchet device.

10. The device of claim 1 wherein said fixed mounting element is fixed to said automobile by a set of brackets.

* * * * *